United States Patent [19]

Neavel

[11] 4,204,843

[45] May 27, 1980

[54] GASIFICATION PROCESS

[75] Inventor: Richard C. Neavel, Baytown, Tex.

[73] Assignee: Exxon Research & Engineering Co., Florham Park, N.J.

[21] Appl. No.: 861,824

[22] Filed: Dec. 19, 1977

[51] Int. Cl.[2] ..... C10J 3/00

[52] U.S. Cl. ..... 48/210; 44/1 R; 48/202

[58] Field of Search ..... 48/202, 206, 210; 252/179, 373; 423/157, 181, 432; 44/1 R, 1 G; 201/38

[56] References Cited

U.S. PATENT DOCUMENTS

| | | | |
|---|---|---|---|
| 2,693,452 | 11/1954 | Goedkoop | 252/179 |
| 4,092,125 | 5/1978 | Stambaugh et al. | 48/210 |

OTHER PUBLICATIONS

"A Novel Approach to Gasification of Coal Using Chemically Incorporated Catalysts," Chauhan et al., 173rd ACS Nat. Meeting, 3/20–25/77, Prepr. 22 #1:38–52, (1977).

The Use of Catalysts in Coal Gasification, Johnson, Catal. Rev. Sci. Eng., 14 (1), (1976), pp. 131–137, 142–148.

Ion Exchange, Helfferich, pp. 5, 6 and 17, 1962.

*Primary Examiner*—S. Leon Bashore
*Assistant Examiner*—Peter F. Kratz
*Attorney, Agent, or Firm*—L. A. Proctor; Wayne Hoover

[57] ABSTRACT

A novel process, and the compositions of matter formed thereby, wherein Group II-A metals, or compounds thereof, can be ion-exchanged onto coal, preferably a high rank coal, notably a subbituminous or bituminous coal, by soaking the coal in an alkali solution of a Group I-A metal compound sufficient to incorporate said metal compound, or cation portion thereof, into said coal to form ion-exchange sites, and ion-exchanging, and thereby replacing all or a portion, preferably a portion, of the Group I-A metal cations with said Group II-A metals. Enhanced gasification rates are achieved by gasification of the so-treated coal, or composition which contains both the Group I-A and Group II-A metals, as contrasted with a coal composition otherwise similar except that it contains an equal molar quantity of either a Group I-A metal or Group II-A metal, rather than both Group I-A and Group II-A metals.

10 Claims, No Drawings

GASIFICATION PROCESS

Before the turn of the century it was known that hydrocarbon gases and liquids, tars and chemicals could be obtained not only from petroleum, but from coal and other carbonaceous solids. Very early processes employed destructive distillation, coal being transformed into gases and petroleum-like liquid products. Primary emphasis in many of these processes is on gasification of the coal with the objective of improving processes for the production of water gas, producer gas, or hydrogen, as opposed to the production of coal liquids. For the past several decades, due to disallocations of supplies, there have been reoccuring periods of interest in the gasification of coal to produce fuel gases, first primarily in Europe; and then, in this country. The art reflects the various periods of interest in terms of peaks defined by large numbers of patents, and literature. Presently existing and projected shortages of natural gas in this country have sparked a renewed and very keen interest in the gasification of coal, and it appears that this will be a long-range trend. Consequently, intensive research and development efforts are now underway to produce synthetic high-BTU, intermediate-BTU and synthesis fuel gases for commercial usages.

It was early recognized that some mineral and trace inorganic constituents naturally present in some coal could exert favorable catalytic influences in gasification reactions vis-a-vis thermal reactions, and a variety of catalytic materials have been added to coal to alter the natural chemistry inherent in various of the early coal gasification processes. The thrust of present research is to develop processes for the production of synthetic high-BTU gases with far higher efficiencies than was possible in the classical European, or early Euro-American processes. There are, however, inherent chemical kinetic limitations in coal gasification processes which have defied solution, and these problems are yet unsolved. Yet, solution is essential, and there remains a strong interest in providing better coal gasification processes, or catalysts for use in catalytic coal gasification processes.

There is a profusion of information covering catalytic coal gasification processes; both domestic and foreign, this including both patents and literature. Illustrative thereof is a recent paper by James L. Johnson; Catal. Rev. Sci. Eng., 14(1) pp. 131–152 (1976), which includes a survey of the catalytic gasification art. Therein various materials have been characterized as generally useful catalysts for the gasification of coal, or carbonaceous solids, the survey naming various metals, metal oxides, metal halides, transition metals, and iron carbonyls. Group I and Group II metal compounds as a class, notably potassium carbonate, sodium carbonate, potassium chloride, sodium chloride, and calcium oxide are given special recognition, it being suggested that few catalysts are as effective in promoting gasification rates as alkali metals, and that none are more active. In the article, the catalytic properties of sodium and calcium are specifically discussed. Each of these cations, respectively, have been ion-exchanged into lignite, exchange being possible, and attributed to the presence of the carboxy functional groups known to be present in lignite, and other low rank coal structures. Gasification rates with steam-hydrogen mixtures were increased when sodium or calcium were added to the lignite via the exchange mechanism. However, attempts to add sodium or calcium to bituminous coals via ion-exchange were unsuccessful due, as suggested in the article, to the lack of exchange sites on high rank coals.

In a catalytic coal gasification process, i.e., one whose object is to produce high-BTU gas, steam, and particulate coal are fed to a gasifier at elevated temperature and pressure and converted to a synthesis gas, or gaseous mixture of high methane content, which contains significant amounts of carbon monoxide and hydrogen which must also be catalytically converted in situ or ex situ within the gasifier to methane. Practical objectives require increased thermal efficiencies, with simultaneous reduction of reactor size and temperature, as well as simplification and reduction of the steps involved in the operation. It has been recognized, and is evident that these and other objectives might be obtainable by improved catalytic materials added to the mass of feed coal. Though much of the prior art disclosures relate to disclosures of physical admixtures of a catalyst and a coal, it has been recognized that a thorough dispersion of the catalyst throughout the coal better promotes gasification rates, and activity than a physical mixture. In the past, however, whereas it has not proven particularly difficult to effectively disperse catalytic materials uniformly throughout low rank coal structures, this has not been true of high rank coals, notably subbituminous and bituminous coals. This is because low rank coals have active sites which makes feasible the exchange of cations onto these sites. With high rank coals, however, the molecular structure of the coal is devoid of such sites.

Nonetheless it has been recognized, and disclosed in pending application Ser. No. 812,032, filed July 1, 1977, by Richard C. Neavel and Robert J. Lang, herewith incorporated by reference, that even high rank coals can be subjected to partial oxidation to generate active exchange sites, and the oxidized coal then ion-exchanged with a suitable catalytic metal cation to improve catalytic performance in the overall gasification process. The data presented therein shows that the gasification rate of bituminous coal is increased with increased concentrations of either the alkali metal, or alkaline earth metal cations present in the coal structure. Though the alkali metal cations, notably potassium are shown the most active, it is also shown that calcium, which is relatively inactive when incorporated as a physical mixture with coal, becomes quite active catalytically when incorporated with the coal via ion-exchange. Moreover, even the catalytic activity of the alkali metals are further improved when ion-exchanged into the coal as contrasted with physical admixture of same with the coal.

It has also been reported by Batelle Memorial Institute, subsequent to this invention, that "Batelle-treated coal" has been prepared from a high rank coal, i.e., Pittsburgh No. 8 coal in Batelle Memorial Institute's Hydrothermal Coal process by treating in aqueous sodium hydroxide/calcium oxide (CaO) solution (0.13:1 CaO to coal) at 250° C. (480° F.), up to 3% of the CaO being chemisorbed on the coal. It is disclosed that at 850° C. (1560° F.) and 500 psig 65% of the treated coal was converted to gases by steam gasification in less than three minutes compared with 90 minutes for untreated coal. S. P. Chauhan (Batelle Memorial Institute, Columbus Lab), K. Woodcock (E.R.D.A.) et al 173rd ACS National Meeting (New Orleans 3/20–25/77) ACS Div. Fuel Chem. Prepr. 22 #1:38–52 (1977).

There is, and remains a crying need for providing better catalytic coal gasification processes, or catalysts for use in catalytic coal gasification processes which are capable of producing high-BTU fuel gases from various coals, particularly high rank coals for commercial usages at improved economies, or efficiencies.

It is, accordingly, the primary objective of the present invention to supply this need.

A particular object is to provide a process for the treatment of coals, notably high rank coals, or coals which have insufficient active sites to permit ion-exchange, to render such coals amenable to gasification at increased rate, with high activities, particularly for use in the production of high-BTU fuel gases.

A more particular object of the invention is to provide a process of such character wherein bituminous coals can be converted into a highly active catalytic species for use in coal gasification reactions, especially for the production of high-BTU fuel gases.

A further object is to provide, as compositions or articles of manufacture, a pretreated particulate coal feed which has been rendered amenable to gasification by treating to form therein relatively inexpensive species of Group I-A or Group II-A metals, or admixtures thereof, in high concentrations.

These objects and others are achieved in accordance with the present invention embodying a novel process, and the compositions of matter formed thereby, wherein Group II-A metals (Periodic Table of the Elements, Sargent-Welch Scientific Company, Copyright 1968), or compounds thereof, can be ion-exchanged onto coal, preferably a high rank coal, notably a subbituminous or bituminous coal, by soaking the coal in an alkali solution of a Group I-A metal compound sufficient to incorporate said metal compound, or cation portion thereof, into said coal to form ion-exchange sites, and ion-exchanging, and thereby replacing all or a portion, preferably a portion, of the Group I-A metal cations with said Group II-A metals. The coal can be treated in a single step using a solution within which both the Group I-A and II-A metal compounds are dispersed, or dissolved, or in multiple steps wherein the coal is first contacted with a solution of the Group I-A metal compound, or compounds, thence with a solution which contains the Group II-A metal compound, or compounds. Enhanced gasification rates are achieved by gasification of the so-treated coal, or composition which contains both the Group I-A and Group II-A metals, as contrasted with a composition otherwise similar except that it contains an equal molar quantity of either a Group I-A metal or Group II-A metal, rather than both Group I-A and Group II-A metals. Moreover, the Group I-A or Group II-A metals can act as a sulfur absorbent during the gasification, or on combustion of the coal.

In a preferred embodiment, a particulate coal containing less oxygen in an active form than would be required to impart from about 2 to about 10 wt. percent calcium ion, particularly a bituminous coal, is contacted and soaked in an alkali solution of a Group I-A metal compound, or compounds, preferably an aqueous alkali hydroxide of from about 0.25 to about 5 normality, more preferably from about 0.5 to about 2 normality, at conditions sufficient to form active sites onto which can be exchanged between about $5\times10^{-4}$ to about $8\times10^{-3}$ gram atom equivalents of a Group I-A metal, preferably from about $1\times10^{-3}$ to about $5\times10^{-1}$ gram atom equivalents of a Group I-A metal. Suitably, the treatment is conducted at temperatures ranging from about 20° F. to about 200° F., preferably from about 40° F. to about 90° F., suitably for periods ranging at least about 0.1 hour, preferably from about 0.25 hour to about 12 hours, more preferably from about 0.25 hour to about 2 hours, when the temperature of the solution is maintained within the expressed preferred ranges. The period of contact, or soak, is not critical, and lesser soak periods can be employed as temperatures are increased and as particle size is decreased. The coal within which ion-exchange sites (i.e., Group II-A cation exchangeable sites) have been created is then, in a preferred embodiment, separated from the alkali solution of the Group I-A metal compound, or compounds, and then contacted and soaked with a solution, dispersion or slurry, preferably an aqueous solution of from about 0.25 to about 5 normality, preferably from about 0.5 to about 2 normality, of a Group II-A metal compound, or compounds, sufficient to exchange at least a portion of the Group I metal cations with Group II metal cations. Solution temperatures ranging from about 20° F. to about 200° F., preferably from about 40° F. to about 90° F., have been found satisfactory for ion-exchange and replacement of Group I-A metal cations by Group II-A metal cations. The period of treatment is not critical, but generally requires at least about 1 hour, suitably from about 0.25 hour to about 48 hours, and preferably from about 1 hour to about 8 hours for adequate exchange at the preferred conditions. Faster exchange rates can be achieved by increasing the temperature of the solution and decreasing the particle size.

In forming the novel compositions, or articles of manufacture, of this invention, suitably from about 1 percent to about 10 percent, preferably from about 3.5 percent to about 7 percent, of the Group I-A metal, or metals, calculated as metallic metal based on the weight of the coal (MAF), is incorporated onto the coal, and from about 1 percent to about 10 percent, preferably from about 3 percent to about 5 percent of the Group I-A metal cation, calculated as metallic metal based on the weight of the coal (MAF), is then replaced with a Group II-A metal, or metals, via ion-exchange. Suitably therefore, the coal is one which contains, after treatments with the solution, or solutions, a sum-total of from about 1 percent to about 10 percent, preferably from about 3.5 percent to about 7 percent, of Group I-A and Group II-A metals, calculated as metallic metal based on the total weight of the coal (MAF). From about 0.5 percent to about 4 percent, preferably from about 0.5 percent to about 2 percent, of the total metal is thus characterized as a Group I-A metal, or metals, and from about 0.5 percent to about 6 percent, preferably from about 3 percent to about 5 percent, as a Group II-A metal, or metals.

The process of this invention is generally applicable for the inclusion of Group I-A and Group II-A metals in virtually any rank of coal, including lignite, brown coal, peat, and the like, subbituminous coals such as Wyodak and the like, and bituminous coals such as Illinois No. 6, Pittsburgh No. 8 and the like. The process, however, has special utility in the treatment of the high rank coals, notably the subbituminous and bituminous coals which have insufficient natural sites to permit high per se dispersion of the Group I-A and Group II-A metals into the structure.

Group I-A metals, or alkali metals, suitable for the practice of this invention are exemplified by lithium, sodium, potassium, rubidium and cesium, the effectiveness of the metals as gasification catalysts increasing in direct proportion to their increased atomic weight, though sodium and potassium are preferred metals based on cost-effectiveness. These are suitably employed as salts or hydroxides, e.g., sodium carbonate, potassium hydroxide, potassium nitrate, cesium nitrate and the like. Suitable Group II-A metals, or alkaline earth metals, are exemplified by magnesium, calcium, strontium and barium, the effectiveness of which for gasification purposes increases in direct proportion to their increased atomic weight except for calcium which is a highly preferred species of Group II metal based on its cost effectiveness. The alkaline earth metals are suitably employed in solution as salts and hydroxides illustrative of which are magnesium carbonate, calcium oxalate, strontium nitrate, barium hydroxide and the like.

In the past, low rank coals have been successfully treated via ion-exchange with alkali or alkaline earth metal cations, including, e.g., sodium or calcium, because of natural exchange sites. The exchange of alkali or alkaline earth metal cations, particularly the latter, into bituminous coals, however, has been ineffective because of the nature of bituminous coals which are lacking in natural exchange sites. In accordance with the present process, nontheless, ion-exchange sites are created in the coal by treatment with the alkali solution, this making feasible the addition, or incorporation of considerably greater amounts of alkaline earth metal cations into the coal than heretofore believed possible. Whereas substantially complete exchange of alkaline earth metal into the created ion-exchange sites is possible, the presence of both alkali and alkaline earth metal cations in the coal is highly preferable for it has been found that gasification rates are considerably higher for a coal which contains both types of metal vis-a-vis a coal similarly treated, and otherwise similar except that it contains either an alkali metal or alkaline earth metal to the substantial exclusion of the other.

Gasification processes as generally known in the art can be improved with respect to yield or conversion rate, or both, when the process of this invention is employed in the formation of the novel feed compositions. The compositions are reacted with a gaseous species or a mixture of gaseous species at elevated temperatures, and generally elevated pressures to produce and optimize the composition of the fuel gases. The gaseous species generally employed as reactants include oxygen, steam, hydrogen, and carbon oxides such as carbon dioxide. Generally, temperature, pressure, flow rate, mole ratios and relative mole ratios depend on the specific process employed and the actual products desired therefrom. In any event, the composition of the gaseous products are altered by the particular catalyst employed. For example, the products resulting from the gasification of coal with steam is enriched in methane by judicious selection of the optimum alkali and alkaline earth metal, and concentrations thereof within the feed composition, to promote the conversion of carbon monoxide and hydrogen to methane. Generally sodium or potassium in relatively high concentration are most preferred when maximum methane production from gasification by steam is desired, and calcium in high concentration is most preferred when production of carbon monoxide and hydrogen by steam gasification is desired. Gasification is generally accomplished by contacting the treated coal with steam at a temperature within the range from about 750° F. to about 1850° F. at a steam flow rate within the range from about 0.2 to about 50 W/W/Hr. Pressure is not critical, but generally ranges from about 0 to about 1000 psig.

These and other features of the present invention will be better understood by reference to the following demonstrations which involve treatment of coals with Group I-A and Group II-A metals, and runs conducted by gasification of the coal with and without benefit of treatment with the alkali and alkaline earth metal compounds and salts, particularly with reference to comparative data showing gasification of coal pretreated with both alkali and alkaline earth metal compounds and salts in accordance with this invention. All units are in terms of weight unless otherwise specified.

In U.S. application Ser. No. 812,032, supra, it was disclosed and exemplified that a Group II metal, notably calcium, could be incorporated onto a bituminous coal by impregnating the calcium on the internal surfaces of the coal via an ion-exchange process. It was also disclosed that ion-exchange capacity could be increased by oxidizing the coal. In accordance with the present invention, a technique other than oxidation is disclosed for enhancing calcium uptake by the coal. Additionally, however, a new composition can be formed by the combination of exchanged calcium and a residual amount of the alkali metal which is a far more active gasification catalyst than a composition formed from either a Group I or Group II metal alone.

EXAMPLE 1

A 15 g. portion of −16 +20 mesh (NBS) Illinois high volatile C bituminous coal was boiled for 3.5 hours in an aqueous 1 normal NaOH solution. The specimen was then soaked in several hundred ml of distilled water for several hours. The specimen was then soaked for several days in about 5 g. of $Ca(OH)_2$ and fresh distilled water. Excess, unutilized $Ca(OH)_2$ was elutriated from the coal specimen.

Analysis of treated coal specimen indicated 5.1 weight percent calcium on the impregnated coal specimen. In contrast, soaking coal not pretreated with NaOH in $Ca(OH)_2$ resulted in an uptake of only 1.9 weight percent calcium. (Boiling a sample of the coal in $Ca(OH)_2$ solution with excess powdered $Ca(OH)_2$ did not enhance the calcium uptake.)

The steam gasification rate at comparable conditions was 1.8 times higher for the NaOH/$Ca(OH)_2$ treated composition than for the $Ca(OH)_2$ composition.

The following example contrasts the difference in uptake of a Group II-A metal from a specimen of coal pretreated with an aqueous solution of a Group I-A metal vis-a-vis uptake of a Group II-A metal by an untreated, but otherwise similar coal specimen.

EXAMPLE 2

A 5 g. sample of the same coal specimen as used in Example 1 was soaked for 64 hours in 2 normal aqueous NaOH at ambient temperature (approximately 76° F.). The specimen was cleared of NaOH and soaked for 55 hours in water containing several grams of $Ca(OH)_2$ powder. Excess, unutilized $Ca(OH)_2$ powder was elutriated from the specimen. The sample was found to contain, after treatment, 4.5 weight percent calcium.

In contrast, a similar coal specimen soaked in $Ca(OH)_2$ only without an NaOH pretreatment took up 2.1 weight percent calcium. Additional tests have established that NaOH treatments as short as 2 hours at room temperature allow subsequent calcium uptake of greater than 4 weight percent.

In accordance with the following data a bituminous coal is treated simultaneously with the Group I-A and II-A metal.

EXAMPLE 3

A 5 g. specimen of the Illinois coal of Examples 1 and 2 was soaked in 52 ml of 1 normal aqueous NaOH containing 0.13 g. powdered $Ca(OH)_2$ (equivalent to 1.4 weight percent calcium on coal) for 89 hours at room temperature. Excess NaOH and $Ca(OH)_2$ were removed with distilled water. The treated sample contained 2.6 weight percent sodium and 1.0 weight percent calcium.

When gasified under conditions identical to those in Example 1, the steam gasification rate was 4.5 times that obtained for the sample exchanged only with $Ca(OH)_2$ and 2.5 times the rate obtained on the specimen that was boiled in NaOH and then exchanged with calcium.

It is apparent that various modifications can be made without departing the spirit and scope of the present invention. Coals, particularly the higher rank coals, are known to contain a limited number of ion-exchange sites. The present invention provides a method for increasing the number of ion-exchange sites; whether on coals which contain a relatively limited number of such sites, or on coals essentially devoid of such sites. It also provides a method for depositing alkaline earth metals, and preferably, both alkali and alkaline earth metals at such sites in high effective concentrations.

Having described the invention what is claimed is:

1. A process for gasifying coal containing less oxygen in an active form than would be required to impart from about 2 to about 10 weight percent calcium ion to produce a fuel gas, which consists essentially of:

(a) contacting and soaking said coal with a solution comprising a Group I-A metal hydroxide at a temperature within the range from about 20° to about 200° F. to increase the concentration of ion-exchange sites within said coal as contrasted with the state of the coal prior to contact with said solution and to incorporate from about 1 weight percent to about 10 weight percent of Group I-A metal cations, then (b) contacting the coal from step (a) with a Group II-A metal compound at a temperature within the range from about 20° to about 200° F. to exchange and replace a portion of the Group I-A metal cations and to incorporate from about 0.5 to about 6.0 weight percent of one or more Group II-A metal cations, thereby producing a treated coal containing from about 0.5 to about 4.0 weight of a Group I-A metal and from about 0.5 to about 6.0 weight percent of a Group II-A metal and then (c) gasifying said treated coal at gasification conditions in a gasification zone to produce fuel gas.

2. The process of claim 1 wherein the coal subjected to treatment with said Group I-A and Group II-A compounds is a bituminous coal.

3. The process of claim 1 wherein the Group I-A metal is sodium or potassium.

4. The process of claim 1 wherein the Group II-A metal is calcium.

5. The process of claim 1 wherein the coal is first treated with a solution of the Group I-A metal compound, and the coal is then separated from said solution and treated by subsequent contact with a solution of the Group II-A metal compound.

6. A process for gasifying coal containing less oxygen in an active form than would be required to impart from about 2 to about 10 weight percent calcium ion to produce a fuel gas, which consists essentially of:

(a) contacting said coal with an aqueous medium comprising a Group I-A metal hydroxide in adequate concentration to provide from about a 0.25 N to about a 5 N solution, and soaking the coal in said solution for a period of at least 0.1 hour at a temperature within the range from about 40° F. to about 90° F. to increase the concentration of ion-exchange sites within said coal, as contrasted with the state of said coal prior to contact with said solution and to deposit from about 3.5 to about 7.0 weight percent of Group I-A metal cations, then (b) contacting the coal from step (a) with an aqueous medium comprising a Group II-A metal compound in adequate concentration to provide from about a 0.5 N to a 5 N solution, and soaking the coal in said solution for a period of at least 1 hour at a temperature within the range from about 40° F. to about 90° F. to exchange and replace a portion of the Group I-A metal cations with from about 3 to about 5 weight percent of Group II-A metal cations thereby producing a coal containing from about 0.5 to about 2.0 weight percent of a Group I-A metal and from about 3 to about 5 weight percent of a Group II-A metal, and then (c) gasifying said treated coal at gasification conditions in a gasification zone to produce fuel gas.

7. The process of claim 6 wherein the coal subjected to treatment with said Group I-A and Group II-A compounds is a bituminous coal.

8. The process of claim 6 wherein the Group I-A metal is sodium or potassium.

9. The process of claim 6 wherein the Group II-A metal is calcium.

10. The process of claim 6 wherein the coal is first treated with a solution of the Group I-A metal compound, and the coal is then separated from said solution and treated by subsequent contact with a solution of the Group II-A metal compound.

* * * * *